US010550340B2

(12) United States Patent
Schleiffer et al.

(10) Patent No.: US 10,550,340 B2
(45) Date of Patent: Feb. 4, 2020

(54) PROCESS AND APPARATUS FOR HYDROCONVERSION OF HYDROCARBONS

(71) Applicant: BP EUROPA SE, Hamburg (DE)

(72) Inventors: Andreas Schleiffer, Lauenbruck (DE); Paul M. Ziegelaar, Beeliar (AU)

(73) Assignee: BP Corporation North America Inc., Houston, TX (US)

( * ) Notice: Subject to any disclaimer, the term of this patent is extended or adjusted under 35 U.S.C. 154(b) by 5 days.

(21) Appl. No.: 15/524,453

(22) PCT Filed: Nov. 4, 2015

(86) PCT No.: PCT/IB2015/002443
§ 371 (c)(1),
(2) Date: May 4, 2017

(87) PCT Pub. No.: WO2016/071776
PCT Pub. Date: May 12, 2016

(65) Prior Publication Data

US 2018/0273860 A1 Sep. 27, 2018

(30) Foreign Application Priority Data

Nov. 6, 2014 (EP) ..... 14192098

(51) Int. Cl.
*C10G 67/02* (2006.01)
*C10G 47/26* (2006.01)
*C10G 65/10* (2006.01)
*C10G 65/12* (2006.01)

(52) U.S. Cl.
CPC ..... *C10G 67/02* (2013.01); *C10G 47/26* (2013.01); *C10G 65/10* (2013.01); *C10G 65/12* (2013.01); *C10G 2300/1074* (2013.01); *C10G 2300/1077* (2013.01); *C10G 2300/4081* (2013.01); *C10G 2400/04* (2013.01); *C10G 2400/08* (2013.01)

(58) Field of Classification Search
CPC ..... B01J 2219/0002; B01J 2219/0006
See application file for complete search history.

(56) References Cited

U.S. PATENT DOCUMENTS 3,207,688 A * 9/1965 Van Driesen ..... C10G 65/02 208/108
4,126,538 A * 11/1978 Goudriaan ..... C10G 67/00 208/108
7,156,977 B2 1/2007 Wrisberg et al.
2009/0288984 A1* 11/2009 Colyar ..... C10G 11/16 208/49
2010/0122934 A1 5/2010 Haizmann et al.
2010/0282640 A1* 11/2010 Rojey ..... C01B 3/36 208/49
2011/0303580 A1 12/2011 Haizmann
2013/0067815 A1* 3/2013 Koseoglu ..... C01B 3/36 48/211
2013/0240406 A1 9/2013 Sadler et al.
2014/0001093 A1* 1/2014 Mezza ..... C10G 67/04 208/96
2014/0275672 A1* 9/2014 Krishnamurthy ..... B01J 19/002 585/256
2014/0275676 A1* 9/2014 Sieli ..... C07C 4/06 585/310
2015/0315480 A1* 11/2015 Hanks ..... C10G 1/06 252/373
2016/0130511 A1* 5/2016 Govindhakannan ... C10G 53/02 208/96
2016/0137933 A1* 5/2016 Ward ..... C10G 69/06 208/60

FOREIGN PATENT DOCUMENTS

RU 2 235 757 9/2004
WO WO-2014/142874 9/2014

OTHER PUBLICATIONS

Mayo, S. et al. Slurry Phase Hydrocracking; Bottoms Upgrading for Today's Market; XP008175831; Chemical Engineering World, Mar. 2014, pp. 52-59.
Beskov, V et al., General Chemical Technology and Principles of Industrial Ecology. Recommended by the Russian Federation ministry of General and Professional Education as a manual for higher school students specialized in chemical technologies (1999).

* cited by examiner

*Primary Examiner* — Randy Boyer
(74) *Attorney, Agent, or Firm* — Kalim S. Fuzail

(57) ABSTRACT

A refinery built around a slurry phase hydrocracking process unit, such as a Veba Combi-Cracker (VCC), is simpler, produces more liquid product as transportation fuels and has much higher net cash margin than a refinery built around a coker or other bottoms upgrading processes. The VCC unit replaces one or more processing steps normally included in refineries as separate and distinct processing units including heavy distillate/gas oil cracking and optionally bottoms upgrading and deep desulfurization of diesel and gasoline range cuts. The refinery design is especially suited for heavy crude upgrading and can be tuned to provide a wide range of gasoline to distillate production ratios. The refinery design is "bottomless" in the sense that it produces no heavy fuel oil or asphalt as product and no solid fuel (e.g., petroleum coke).

4 Claims, 6 Drawing Sheets

PROCESS AND APPARATUS FOR HYDROCONVERSION OF HYDROCARBONS

TECHNICAL FIELD

The invention is related to a process for the thermal hydrogenation conversion of heavy hydrocarbon feedstocks.

BACKGROUND

As the world's supply of crude oil becomes heavier and contains higher sulfur levels, there is a challenge is to meet the growing demand for light, high-quality, low-sulfur transportation fuels. The upgrading of heavy hydrocarbon feedstocks may help to meet this demand. Several processes are useful for upgrading heavy hydrocarbon feedstocks. One such process is known as slurry phase hydrocracking. Slurry-phase hydrocracking converts any hydrogen and carbon containing feedstock derived from mineral oils, synthetic oils, coal, biological processes, and the like, hydrocarbon residues, such as vacuum residue (VR), atmospheric residue (AR), de-asphalted bottoms, coal tar, and the like, in the presence of hydrogen under high temperatures and high pressures, for example, from about 750° F. (400° C.) up to about 930° F. (500° C.), and from about 1450 psig (10,000 kPa) up to about 4000 psig (27,500 kPa), or higher. To prevent excessive coking during the reaction, finely powdered additive particles made from carbon, iron salts, or other materials, may be added to the liquid feed. Inside the reactor, the liquid/powder mixture ideally behaves as a single homogenous phase due to the small size of the additive particles. In practice, the reactor may be operated as an up-flow bubble column reactor or as a circulating ebulated bed reactor and the like with three phases due to the hydrogen make up and light reaction products contributing to a gas phase, and larger additive particles contributing to a solid phase, and the smaller additive particles, feedstock and heavier reaction products contributing to the liquid phase, with the combination of additive and liquid comprising the slurry. In slurry phase hydrocracking, feedstock conversion may exceed 90% into valuable converted products, and even more than 95% when a vacuum residue is the feedstock.

One example of slurry phase hydrocracking is known as Veba Combi-Cracking™ (VCC™) technology. This technology typically operates in a once through mode where a proprietary particulate additive is added to a heavy feedstock, such as vacuum residue (VR), to form a slurry feed. The slurry feed is charged with hydrogen and heated to reactive temperatures to crack the vacuum residue into lighter products. The vaporized conversion products may or may not be further hydrotreated and/or hydrocracked in a second stage fixed bed catalyst reactor. It produces a wide range of distillate products including vacuum gas oil, middle distillate (such as diesel and kerosene), naphtha and light gas.

While the slurry phase hydrocracking is known for treating heavy fractions obtained from distilled crude oil, many refineries utilize other standalone processing units to convert middle fractions of crude oil into more valuable diesel and gasoline products. For example, heavy vacuum gas oil may be sent to a standalone hydrocracker to produce hydrocracked diesel, kerosene and gasoline. Vacuum gas oil and heavy atmospheric distillate may be sent to a standalone fluid catalytic cracker (FCC) to produce FCC gasoline. The mid-distillates (diesel and kerosene) obtained from an atmospheric distillation unit may be finished with a hydrotreater unit to obtained finished diesel or jet fuel. Naphtha fractions may be introduced into a hydrotreater unit before being sent to a catalytic reformer unit or isomeration unit to obtain reformate or isomerate useful for blending in a gasoline pool.

Despite the various processes and alternatives available for upgrading heavy hydrocarbons and lighter crude oil fractions, there is still a need for improving the existing processes to benefit the economics, efficiency and effectiveness of the unit operations. Likewise, in designing new grass root refineries, there are opportunities to develop simpler flow schemes with fewer standalone process units while still maintaining a full upgraded product slate, thereby significantly reducing operating complexity and capital requirements.

SUMMARY

A process and apparatus for the processing of hydrocarbon feedstocks designed around a slurry phase hydrocracking unit provides a simple refinery flow scheme with fewer standalone processing units.

In a first aspect, the process includes: introducing a hydrocarbon feedstock into an atmospheric distillation unit to form products including straight run light distillate, straight run mid-distillate and atmospheric bottoms; introducing the atmospheric bottoms into a vacuum distillation unit to form products including straight run vacuum gas oil and vacuum residue; introducing the vacuum residue into first stage hydroconversion slurry reactor(s) in a slurry hydrocracking unit to form first stage reaction products; introducing the first stage reaction products and the straight run vacuum gas oil into a second stage hydroprocessing reaction section in the slurry phase hydrocracking unit to form second stage reaction products; introducing the second stage reaction products into a fractionation unit to form recovered products including fuel gas, recovered naphtha, recovered mid-distillate and recovered unconverted vacuum gas oil; and introducing at least a portion of the recovered unconverted vacuum gas oil as a recycle stream into the second stage hydroprocessing reaction section in the slurry phase hydrocracking unit, wherein the atmospheric distillation unit and the vacuum distillation unit produces no products that are introduced into a fluid catalytic cracking (FCC) unit. Preferably, no such products are introduced into a coking unit or a standalone hydrocracking unit.

In a second aspect, the apparatus includes: an atmospheric distillation unit; a vacuum distillation unit receiving a first feedstream from the atmospheric distillation unit; a slurry phase hydrocracking unit receiving a second feedstream from the vacuum distillation unit and a third feedstream from the atmospheric distillation unit; and a fractionation unit receiving a fourth feedstream comprising a product from the slurry phase hydrocracking unit, and producing products including a naphtha product, a diesel product; with the proviso that the refinery apparatus does not include a fluid catalytic cracking unit.

These and other aspects and embodiments and the appurtenant advantages are illustrated in more detail with reference to the drawings and detailed description that follow.

DETAILED DESCRIPTION

Figure 1:
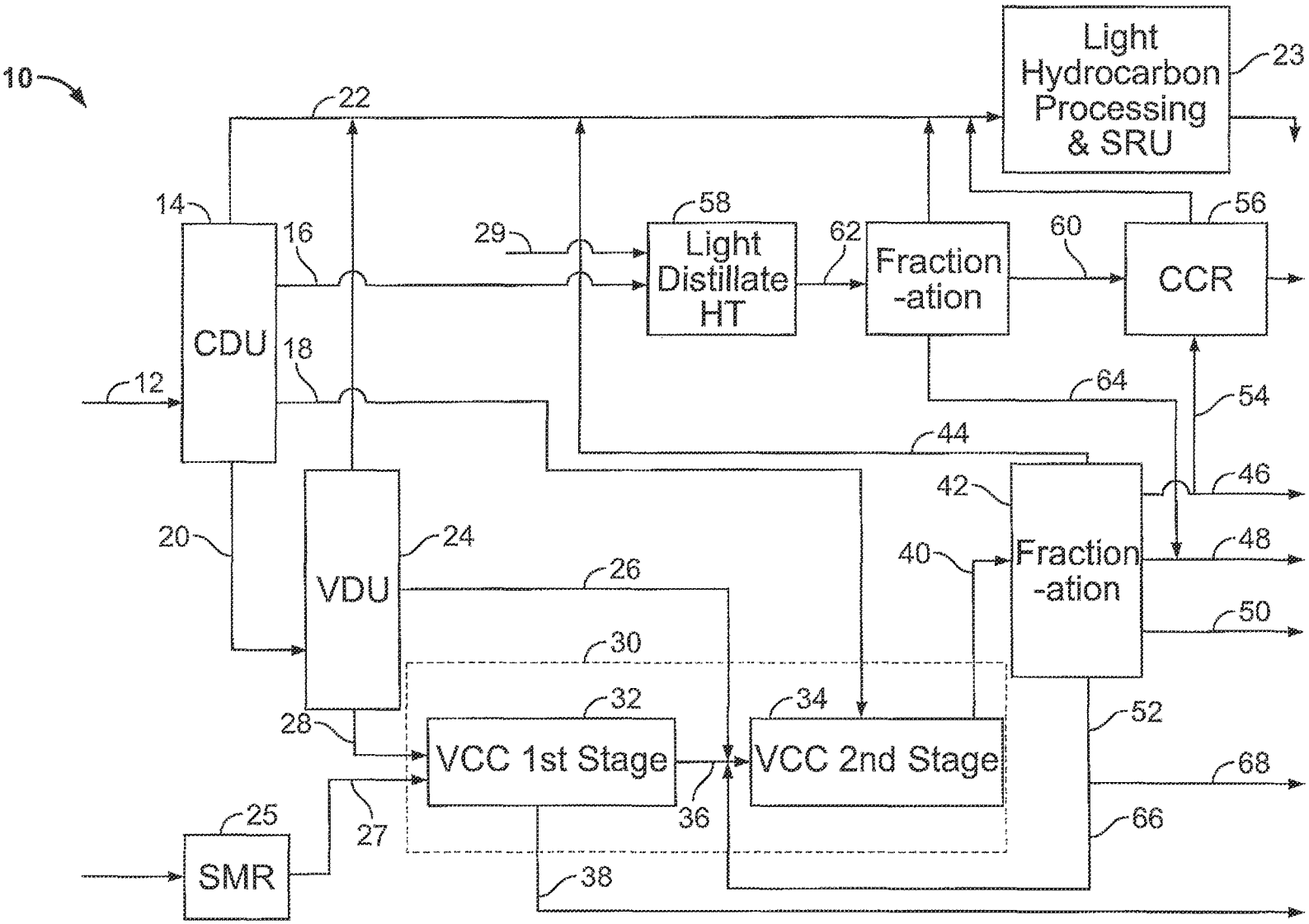
FIG. 1 is a representative simplified process flow diagram of the major processing units and apparatus of a refinery according to one embodiment.

A simple configuration for a refinery flow scheme, petrochemical process and/or refining apparatus may be implemented with a slurry phase hydrocracking process, such as Veba Combi-Cracking™ (VCC™) technology. The refinery flow scheme takes advantage of the integrated hydrocracking and hydroprocessing reactors of the VCC unit (i.e., slurry phase hydrocracking unit) to eliminate the standalone hydrocracking units, fluid catalytic cracking (FCC) unit, coking unit and standalone hydrotreating units found in conventional refinery flow schemes. One feature of the slurry phase hydrocracking technology used in various embodiments of the invention is the potential to commingle virgin gas oil with the product from the first stage hydrocracking slurry reactor (e.g., liquid phase hydroconversion reactor) as feed to the second stage integrated catalytic hydroprocessing reaction section (e.g., gas phase or mixed phase hydroprocessing reactors) of the slurry hydrocracking unit.

Another feature of the slurry phase hydrocracking technology used in various embodiments of the invention is the ability to hydrocrack gas oil in the second stage integrated hydroprocessing reaction section of the VCC unit. This can be done conventionally in one or more reactor vessels to hydrotreat to low nitrogen levels, followed by hydrocracking over bi-functional hydrocracking catalyst, followed by post-treating to minimize sulfur recombination. Moreover, the hydroconversion in the second stage acts as a post-treating step for finishing the hydrocracked product from the first stage slurry hyrdrocracking reactor. Post-treating may be performed in separate reactor which is integrated into the slurry phase hydrocracking unit high pressure section after the hydrocracking step to process all hydrocracking effluents. In addition, straight run diesel and/or straight run naphtha from the crude unit atmospheric distillation column can be fed into the post-treater section. The second stage integrated hydroprocessing reaction section may also be referred to as the second stage hydroprocessing multi-reactor system. As such, the multi-reactor system may consist of from one to five reactors, each of with one or more catalyst beds, with a preferred configuration of three reactors, such as illustrated in exemplary manner below.

Taking advantage of the high temperature and high pressures at which the slurry phase hydrocracking unit operates, it is possible to embed the slurry phase hydrocracking unit at the heart of the reaction section in the configuration of a refinery to deliver a flow scheme that is simpler than current state-of-art refinery designs and at the same time delivers higher carbon retention and therefore yields of liquid products. It is particularly advantageous for processing heavy crude oils containing high volumes of vacuum residue, but also advantageous over a wide range of medium and heavy sour crude oils, for example, crude oils having an API of less than 32°, or preferably less than 30°, or in other terms, a specific gravity (SG) of more than 0.86 or preferably 0.88 or higher. Advantageous crude oils to process include, for example, but are not limited to, Arabian Heavy (API 27.7°, SG 0.89) (where SG is the abbreviation for specific gravity), Kuwait Blend (API 30.2°, SG 0.88), Maya (API 21.8°, SG 0.92), Merey (API 16°, SG 0.96), and North Slope Alaska (API 31.9°, SG 0.87). Other hydrocarbon feedstocks that may be processed include Canadian Heavy, Russian Heavy, tar sands, coal slurries, and other hydrocarbons with an API as low as 8.6°, for example, or lower, or SG as high as 1.01, for example, or higher.

A slurry phase hydrocracking unit conventionally processes vacuum residue as a primary feedstock, and is considered a superior technology to coking. A slurry phase hydrocracking unit, in particular a VCC unit, may obtain greater than 95% conversion of vacuum residue with superior liquid yields to coking and other bottoms upgrading technologies. Because the slurry phase hydrocracking unit advantageously upgrades vacuum residue into higher value lighter distillates, the slurry phase hydrocracking unit may integrate a wide range of lighter feedstocks from other streams of the crude unit. For example, in one embodiment of the refinery flow scheme, the slurry phase hydrocracking unit may be configured to process virgin gas oils, such as vacuum gas oil from a crude unit vacuum distillation column, in its integrated second stage hydroprocessing reaction section. Further, the operating pressure of the integrated second stage hydroprocessing reaction section is sufficient to support full hydrotreating and/or hydrocracking operations. As a result, the slurry phase hydrocracking unit may incorporate several refinery processing steps previously included in conventional refinery flow schemes.

Accordingly, embodiments of the refinery flow scheme provide several advantages. The slurry phase hydrocracking unit at the heart of the refinery flow scheme has the ability to co-process virgin gas oil from the refinery crude unit. The slurry phase hydrocracking unit has the ability to hydrocrack gas oil in the second stage hydroprocessing reaction section, thus eliminating the need for separate refinery gas oil processing units, such as a standalone gas oil hydrocracker or a fluid catalytic hydrocracker (FCC). An FCC unit typically burns 5-10% of the carbon content of its feed in the catalyst regenerator. Thus, it is advantageous to not include an FCC unit to obtain higher carbon retention into liquid fuel products and reduce gasoline production, as well as significant capital savings from the simplified refinery structure.

The slurry phase hydrocracking unit also can be configured to provide deep product desulfurization, such as including, but not limited to diesel treatment to ULSD specs, and naphtha treatment to typical reformer feed specs, thus eliminating the need for separate refinery hydrotreating units such as standalone diesel hydrotreater units and naphtha hydrotreating units. As a result of these advantages, embodiments of the refinery flow scheme may produce more transportation fuel products (gasoline, jet fuel and diesel) per barrel of crude oil compared to conventional refinery designs, which include gas oil hydrocracking units. Embodiments of the refinery flow scheme may be especially suited to markets where diesel is the preferred transportation product, and the refinery operations may be adjusted to provide a wide range of gasoline—diesel production ratios depending on temporal and seasonal demands.

One embodiment of the refinery flow scheme utilizing the aforementioned advantages includes a process for the conversion of hydrocarbon feedstocks. The process includes: introducing a hydrocarbon feedstock, such as a crude oil, into an atmospheric crude distillation unit to form products including straight run light distillate, such as straight run naphtha, straight run mid-distillate and atmospheric bottoms; introducing the atmospheric bottoms into a vacuum distillation unit to form products including straight run vacuum gas oil and vacuum residue; introducing the vacuum residue into a slurry phase or liquid phase first stage hydroconversion reactor in a slurry phase hydrocracking unit to form first stage reaction products; introducing the first stage reaction products and the straight run vacuum gas oil into a second stage hydroprocessing reaction section in the slurry phase hydrocracking unit to form second stage reaction products; introducing the second stage reaction products into a fractionation unit to form recovered products including fuel gas, recovered naphtha, recovered mid-distillate and recovered vacuum gas oil; and introducing the recovered vacuum gas oil as a recycle stream into the second stage hydroprocessing reaction section in the slurry phase hydrocracking unit. Preferably, substantially all of the recovered vacuum gas oil is introduced into the second stage hydroprocessing reaction section in the slurry phase hydrocracking unit. Preferably, no products from the atmospheric crude distillation unit or the vacuum distillation unit are introduced into a fluid catalytic cracking unit.

In one embodiment, the straight run naphtha, the straight run mid-distillate or both may be introduced with the straight run vacuum gas oil into the second stage hydroprocessing reaction section in the slurry phase hydrocracking unit. Alternatively in another embodiment, the straight run naphtha, the straight run mid-distillate or both are introduced into a hydrotreating reactor to form hydrotreated products, and the hydrotreated products are introduced into the fractionation unit.

In another aspect, the process obtains recovered products from the slurry hydrocracking fractionation unit that represent a liquid yield of more than 80%, preferably more than 85%, relative to the amount of atmospheric bottoms. The process may also obtain recovered products from the slurry hydrocracking fractionation unit that include a carbon retention of more than 85%, preferably more than 90%, relative to the amount of carbon in the atmospheric bottoms. In another aspect, the noted liquid yields and/or carbon retention carbon may be obtained using as a hydrocarbon feedstock a heavy crude oil comprising an API of less than 32°, or preferably less than 30°, or a heavy crude oil comprising a specific gravity of 0.86 or higher, or preferably 0.88 or higher.

One advantage of the refinery flow scheme is that certain processing units found in conventional refineries may be eliminated. As such, in a preferred embodiment of the refinery flow scheme, the atmospheric distillation unit and the vacuum distillation unit produces no products that are introduced into a fluid catalytic cracking (FCC) unit. It is also optionally preferred that the straight run naphtha is not introduced into a naphtha hydrotreating unit, and optionally preferred that the straight run mid-distillate is not introduced into a diesel hydrotreating unit, thus eliminating the need for both stand-alone hydrotreating units. Moreover, in certain configurations, standalone gas oil hydrocracking units and/or coking units may be eliminated.

Another advantage of the refinery flow scheme is that certain heavy low value products may be eliminated by taking advantage of the VCC unit ability to upgrade heavier feedstocks. As such, in the preferred embodiments of the refinery flow scheme no heavy fuel oil and no asphalt are produced as a product. Also, without a coking unit, no petroleum coke is produced as a product.

To implement embodiments of the refinery flow scheme, various embodiments of refinery apparatus may be provided. In one embodiment, an integrated hydrocarbon refinery apparatus for producing a light distillate product, such as naphtha, and a mid-distillate product, such as diesel, includes an atmospheric distillation unit; a vacuum distillation unit receiving a first feedstream from the atmospheric distillation unit; a slurry hydrocracking unit receiving a second feedstream from the vacuum distillation unit and a third feedstream from the atmospheric distillation unit; and a fractionation unit receiving a fourth feedstream comprising a product from the slurry hydrocracking unit, and producing products including a naphtha product, a mid-distillate product; with the proviso that the refinery apparatus does not include a fluid catalytic cracking unit. Preferably, the refinery apparatus not include any alone gas oil hydrocracking unit. In preferred embodiments, the refinery apparatus the refinery apparatus does not include a naphtha hydrotreating unit and/or does not include a diesel hydrotreating unit.

In preferred embodiments of the refinery apparatus, the slurry hydrocracking unit includes a first stage hydroconversion slurry reactor in communication with a second stage hydroprocessing reaction section including a hydrocracking reactor, wherein the first stage hydroconversion slurry reactor receives the second feedstream and the second stage hydroprocessing reaction section receives the third feedstream. Preferably, the fractionation unit includes a product stream in recycle communication with a second stage hydroprocessing reactor, whereby recovered vacuum gas oil may be recycled with the feedstream to the hydroprocessing reactor. Alternatively, the recovered unconverted vacuum gas oil may be fed to a separate hydroprocessing reactor and the effluent combined with the effluent from the other hydroprocessing reactor.

In other preferred embodiments, the slurry hydrocracking unit further includes a hydrotreating reactor in communication with the fractionation unit, where the hydrotreating reactor receives feedstreams from the atmospheric distillation unit, such as straight run naphtha and/or straight run diesel, and reaction products from the second stage hydroprocessing reactor. Other apparatus useful for the refinery flow scheme will be clear to one of ordinary skill in the art based on the following descriptions and examples of the processes operated by this refinery flow scheme.

Referring to FIG. 1, a simplified process flow diagram illustrates one embodiment of a refinery flow scheme incorporating a slurry phase hydrocracking unit in accordance with the teachings herein. The refinery 10 includes a crude oil feed stream 12 that is introduced into a crude distillation unit (CDU) 14. The significant products of relevance from the crude distillation unit are the straight run naphtha stream 16, the straight run mid-distillate stream 18, and the bottoms 20 from the atmospheric distillation column in the crude distillation unit. The gas product stream 22 from the crude distillation unit is processed in conventional light hydrocarbon processing and sulfur recovery units 23 processing techniques. More products may be obtained from the crude distillation unit, but in this embodiment a simplified refinery configuration may be obtained by using broad boiling point range fractions in the straight run naphtha product stream 16 and the middle distillate product stream 18.

The atmospheric bottoms 20 is introduced as the feed stream to the vacuum distillation unit 24. The vacuum distillation unit produces a vacuum gas oil (VGO) product stream 26 and a vacuum residue product stream 28. The vacuum residue 28 is introduced to the liquid phase first stage reaction section 32 of slurry hydrocracking unit 30. Preferably, the slurry phase hydrocracking unit 30 is a Veba Combi-Cracking™ unit (VCC). However, other slurry phase hydrocracking units licensed by others may be configured to operate in similar refinery configurations as disclosed herein. The VGO stream 26 is introduced to the second stage reaction section 34 of the VCC. The mid-distillate product stream 18 may be introduced into mid-stream sections of the second phase reactions section 34, as described in more detail below. Optionally, the VGO product stream 26 may be combined with the mid-distillate product stream 18 before being introduced to the second stage 34 of VCC unit.

The vacuum residue stream 28 is introduced into the slurry phase hydrocracking unit as a feed stream for the first stage hydroconversion slurry reaction section 32. The first stage reaction product 36 is introduced as the feed stream to the second stage hydroprocessing reaction section 34. A heavy VCC residue product 38 from the first stage reactor section may be recycled into the feedstock of this unit (not shown), or may be used for other products, such as pitch or asphalt. The combined reaction products 40 from the second stage hydroprocessing reaction section 34 are introduced to the product fractionation unit 42.

The product fractionation unit 42 includes a product fractionation column and other apparatus to separate the reaction products from the slurry hydrocracking unit into a slate of various distillates and other products, which may be essentially sulfur free. The products include a light gas stream (e.g., LPG) 44, a naphtha product stream 46, a mid-distillate kerosene product stream 48, a diesel product stream 50, and a recovered vacuum gas oil product stream 52. Preferably the diesel product stream 50 would have a sufficient cetane number to be used for producing a Euro-5 diesel product. The naphtha product stream 46 may be a suitable feedstock 54 for a catalytic reforming unit 56 for making petrochemicals or gasoline products. The recovered vacuum gas oil product stream 52 may be recycled back to the slurry phase hydrocracking unit 30 as an additional feed stream 66 to the second stage hydroprocessing reaction section 34. Optionally, a portion of the recovered vacuum gas oil product stream 68 may be used as a fuel oil product.

In alternative embodiments, the straight run naphtha product stream 16 (or a broader light distillate cut, depending on the CDU 14 operations) may be sent to a standalone light distillate hydrotreating unit 58. The product stream 60 may be introduced to a reforming unit 56 or an isomerization unit (not shown). When a broader light distillate is cut from the CDU, the hydrotreated distillate 62 may be fractionated with the lighter naphtha cut introduced to the reforming unit and the heavier kerosene product cut 64 may be combined with the kerosene product cut 48 from the slurry hydrocracking unit fractionation unit 42. Optionally, a portion of the straight run mid-distillate stream 18 may be sent to a standalone diesel hydrotreating unit (not shown), the product of which may be combined with the diesel from the product 50 from the slurry hydrocracking unit fractionation unit 42. Optionally, a steam methane reformer unit 25 may be used to convert natural gas to provide a source of hydrogen make up gas 27 to the slurry hydrocracking unit 30, or hydrogen make up gas 29 to the light distillate hydrotreating unit 58.

Typically, the slurry phase hydrocracking unit may operate over a broad range of feed and finished products. Typically, the vacuum distillation unit residue has a temperature cut greater than 540° C., and the straight run vacuum gas oil (VGO) has a temperature cut between about 320° C. and 540° C. From these feeds, the VCC product fractionator may be operated to provide a range of products with the following typical temperature cuts ranging between: naphtha 70-180° C., kerosene 160-280° C., diesel 240-380° C., and unconverted oil (UCO) 320-540° C. Finished products may range from gasoline at between 50-220° C., kerosene at between 160-300° C., and diesel at between 180-380° C.

Figure 2:
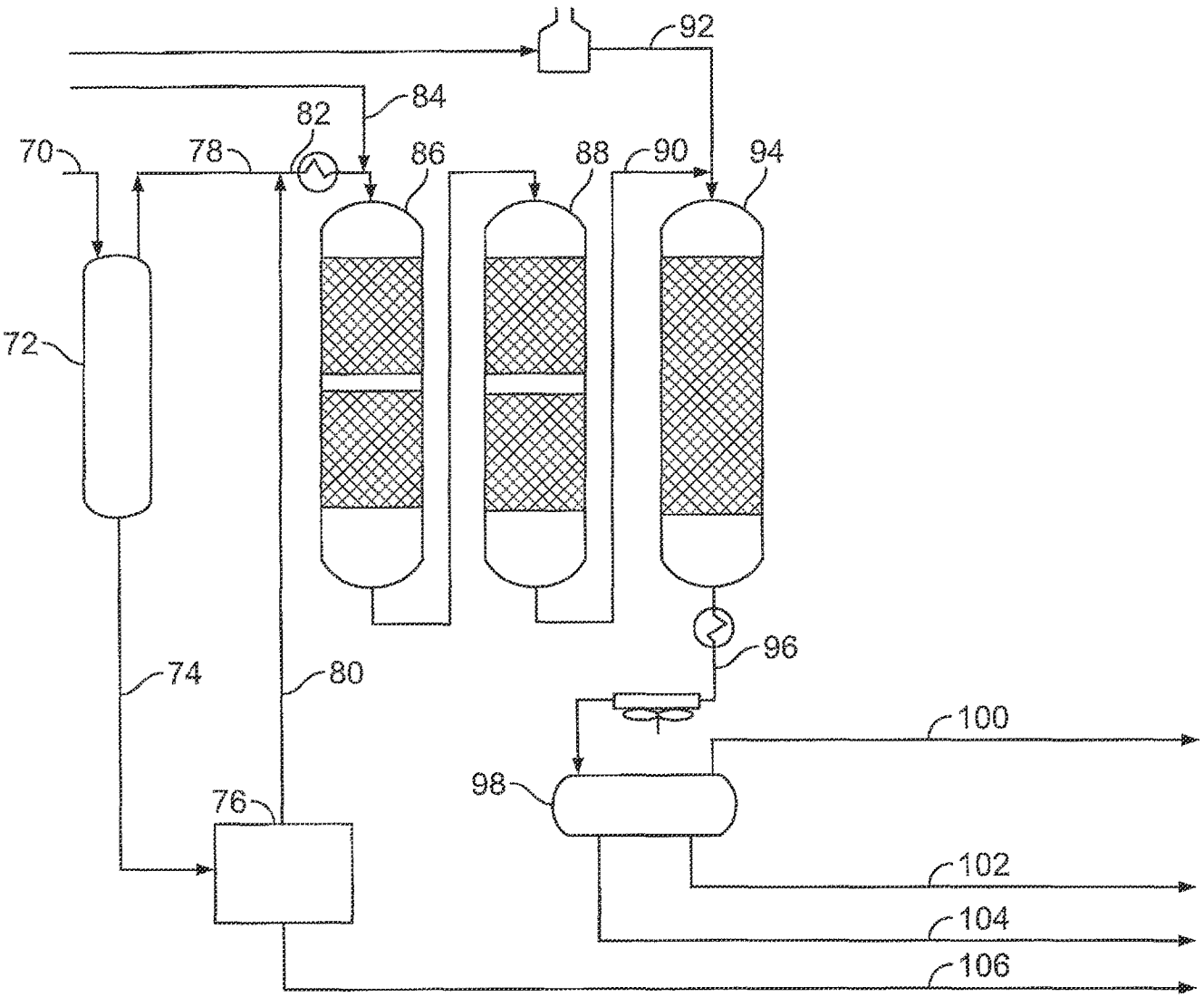
FIG. 2 is a representative simplified process flow diagram of the slurry phase hydrocracking process unit according to another embodiment.

Referring to FIG. 2, a simplified process flow diagram illustrating one embodiment of a slurry phase hydrocracking unit is shown and may be useful in a refinery flow scheme such as shown in FIG. 1. The reactor effluent 70 from a first stage hydroconversion slurry phase reactor (not shown) is introduced into a hot separator 72. The bottoms stream 74 of the hot separator includes the slurry hydrocracking residue and is fed to a slurry vacuum distillation unit 76. The light gas phase product stream 78 from the hot separator may be combined with the heavy distillates stream 80 recovered from the slurry vacuum distillation unit and the combined feed stream 82 may be combined with the vacuum gas oil stream 84 recovered from the crude oil vacuum distillation unit and introduced as the feed to the second stage hydroprocessing reaction section, including catalyst loaded reactors 86 and 88.

The second stage catalytic reactors 86 and 88 may include fixed bed catalyst sections for integrated hydrotreating, hydrocracking and post-treating the combined feed. Alternatively, separate reactors for the different catalysts may be used. Optionally, the effluent 90 from the second second-stage reactor 88 may be combined with a straight run mid-distillate cut stream 92 from the crude atmospheric distillation unit and fed to a third second-stage hyroprocessing reactor 94 that includes a fixed bed catalyst section for post-finishing and hydrotreating the mid-distillate stream. The second stage reactor operating temperature typically ranges from 300 to 400° C. (572 to 752° F.). Second stage reactor pressures are typically set by the pressure requirements for the first stage reaction section so that common gas compression equipment can be used for both stages.

Suitable hydrotreating catalysts for the second stage hydroprocessing reactor section generally consist of an active phase dispersed on high surface area carrier. The active phase is generally a combination of Group VIII and VIB metals in the sulfide form. The carrier is generally gamma alumina with various promoters including Group IIA-VIIA elements and zeolites. The catalyst particle size, shape and pore structure are optimized for the specific feed stocks to be processed.

Suitable hydrocracking catalysts for the second stage hydroprocessing reactors may contain both cracking and hydrogenation function and are therefore generally referred to as bi-functional catalysts. The cracking function can be provided by amorphous, amorphous plus zeolite or just zeolite materials. The hydrogenation function can be provided by materials that are similar to hydrotreating catalyst. These materials with cracking and hydrogenation function are combined with a binder to produce catalyst particles with size, shape and pore structure optimized for the specific feed stocks to be processed. Suitable catalysts include those conventionally used in refining processes, and specialty single or multipurpose catalysts. The catalysts may be arranged in a single bed, in multiple beds integrated in a single reactor vessel, separately in multiple reactors, or any combination, depending on the needs of the feedstock and desired product slate.

Suitable catalysts may be arranged in a variety of configurations. In one example of the configuration of the embodiment of FIG. 2, the first second-stage reactor 86 may contain two beds of hydrotreating catalyst, the second second-stage reactor 88 may contain two beds of a hydrocracking catalyst, and the third second-stage reactor 94 may contain a bed of a hydrotreating catalyst.

The effluent 90 from the second second-stage hydroprocessing reactor, or the effluent 96 from the third second-stage hydroprocessing reactor 94 (if that option is used), is sent to a second stage separator 98. The gas stream 100 from the separator 98 is sent for recovery of the hydrogen for recycle back in the slurry phase hydrocracking unit and the other off gases are sent for treatment. The liquid product stream 102 from the separator is sent to the product fractionation unit. The process water stream 104 recovered from the separator may be sent to a water stripper. The residue bottoms 106 from the slurry vacuum distillation unit may be recycled back to the slurry phase first stage hydroconversion reactor or may be used for other products, such as pitch or asphalt.

Figure 3:
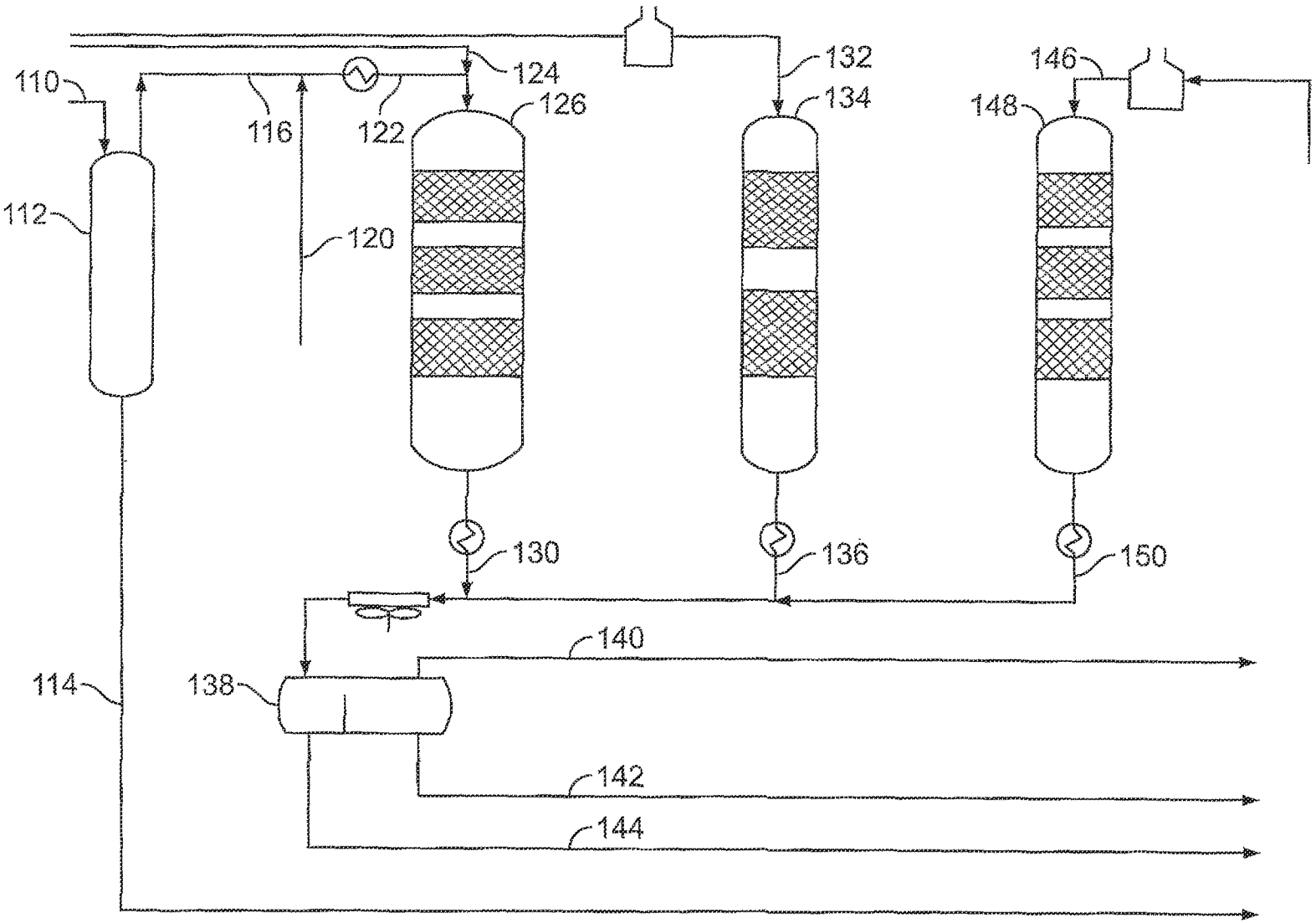
FIG. 3 is a representative simplified process flow diagram of the slurry phase hydrocracking process unit according to still another embodiment.

Referring to FIG. 3, a simplified process flow diagram illustrating another embodiment of a slurry phase hydrocracking unit is shown and may be useful in a refinery flow scheme such as shown in FIG. 1. The reactor effluent 110 from a slurry phase first stage hydroconversion reactor (not shown) is introduced into a hot separator 112. The bottoms stream 114 of the hot separator includes the slurry hydrocracking residue and is fed to a slurry vacuum distillation unit (not shown). The light gas phase product stream 116 from the hot separator may be combined with the heavy distillates stream 120 recovered from the slurry vacuum distillation unit and the combined feed stream 122 may be combined with the vacuum gas oil stream 124 recovered from the crude oil vacuum distillation unit and introduced as the feed to a first second-stage hydroprocessing reactor 126.

The first second-stage hydroprocessing reactor 126 may include fixed bed catalyst sections for integrated hydrotreating, hydrocracking and post-treating the combined feed. Alternatively, separate reactors for the different catalysts may be used. The effluent 130 from the first second-stage hydroprocessing reactor 126 is sent to a second stage hydroprocessing reaction section separator 138. Optionally, a straight run mid-distillate cut stream 132 from the crude atmospheric distillation unit is fed to a second second-stage hydroprocessing reactor 134 that includes a fixed bed catalyst section for post-finishing and hydrotreating the mid-distillate stream. The effluent 136 from the second second-stage hydroprocessing reactor 134 (if that option is used) is sent to the second stage hydroprocessing reaction section separator 138. Optionally, multiple second stage hydroprocessing reaction section separators (not shown) may be deployed independently or in combination for the effluent from the individual second stage hydroprocessing reactors.

The gas stream 140 from the separator 138 is sent for recovery of the hydrogen for recycle back in the slurry phase hydrocracking unit and the other off gases are sent for treatment. The liquid product stream 142 from the separator is sent to the product fractionation unit. The water stream 144 recovered from the separator may be sent to a water stripper.

The residue bottoms 146 from the slurry hydrocracking product fractionation unit contains primarily unconverted oils from the slurry hydrocracking reaction and may be fed into a third second-stage hydroprocessing reaction section reactor 148 that may include fixed bed catalyst sections for integrated hydrocracking and post-treating. Alternatively, separate reactors for the different catalysts may be used. The effluent 150 from the third second-stage hydroprocessing reaction section reactor 148 (if that option is used) is sent to the second stage separator 138.

Suitable catalysts may be arranged in a variety of configurations. In one example using the configuration of the embodiment of FIG. 3, the first second-stage reactor 126 may contain three beds sequentially of hydrotreating catalyst, bi-functional hydrotreating/hydrocracking catalyst and hydrocracking catalyst. The second second-stage reactor 134 may contain two beds sequentially of hydrotreating catalyst and bi-functional hydrotreating/hydrocracking catalyst. The third second-stage reactor 148 may contain three beds sequentially of hydrotreating catalyst, hydrocracking catalyst and hydrocracking catalyst.

The above exemplary embodiments and other embodiments may be understood and be more evident by the following quantitative example and comparative examples.

EXAMPLES

A computational simulation of the mass balance and product yield of a refinery process in accordance with an embodiment of the invention is performed and compared with the simulation results of two comparative examples. For comparison of the different hydrocracking reaction configurations in the refinery flow scheme, Example 1 is a refinery flow scheme with a VCC unit only, Comparative Example 2 is a refinery flow scheme with a VCC and a FCC unit, and Comparative Example 3 is a refinery flow scheme with a Delayed Coker and a FCC unit.

The simulation is performed for all three examples using the following feedstock and assumptions:

The feed to the crude distillation unit (CDU) is Arabian Heavy. The crude distillation unit is operating at a 173,834 bpd capacity based on a 50,000 bpd maximum first stage reactor capacity in the slurry hydrocracking (VCC) unit. The cut point for the atmospheric residue bottoms is 360° C. and has a carbon content of 82.1 wt. %. The vacuum distillation unit (VDU) is operated with a cut point for the vacuum residue of 550° C.

The fluid catalytic cracking (FCC) unit is operated with a 65% vacuum gas oil (VGO) conversion, a light naphtha end point of 121° C., and a heavy naphtha end point of 221° C. The FCC coke contains 90 wt. % carbon, the FCC gases contain 57 wt. % carbon, the FCC LPG contains 83 wt. % carbon and the FCC naphtha and light cycle oil (LCO) each contain 84.5 wt. % carbon.

The delayed coking unit (DCU) is operated with a C1-C4 gas make of 11 wt. % of the feed. The DCU produces a coke make of 34.53 wt. %. The coke has a carbon content of 91 wt. %. The DCU liquid products have a combined density of 0.900 t/m3 and a carbon content of 85.9 wt. %. The carbon content of the hydrocarbon gases is 80 wt. %.

The slurry hydrocracking (VCC) unit includes a slurry phase first stage hydroconversion reaction section and a second stage hydroporcessing reaction section. The first stage section has a mass conversion of 83 wt. %. The first stage product undergoes a density reduction of 86% as a percent of the first stage feed density. The second stage section has a 1.5 wt. % gas make. The second stage product undergoes a density reduction of 80.1% as a percent of the second stage feed density. The second stage liquid products have a carbon content of 85.9 wt. %. The carbon content of 50 wt. % in the second stage gas stream balances the process.

As shown in the examples below, Example 1 shows superior liquid product yield and carbon retention relative to the comparative examples.

Example 1

Figure 4:
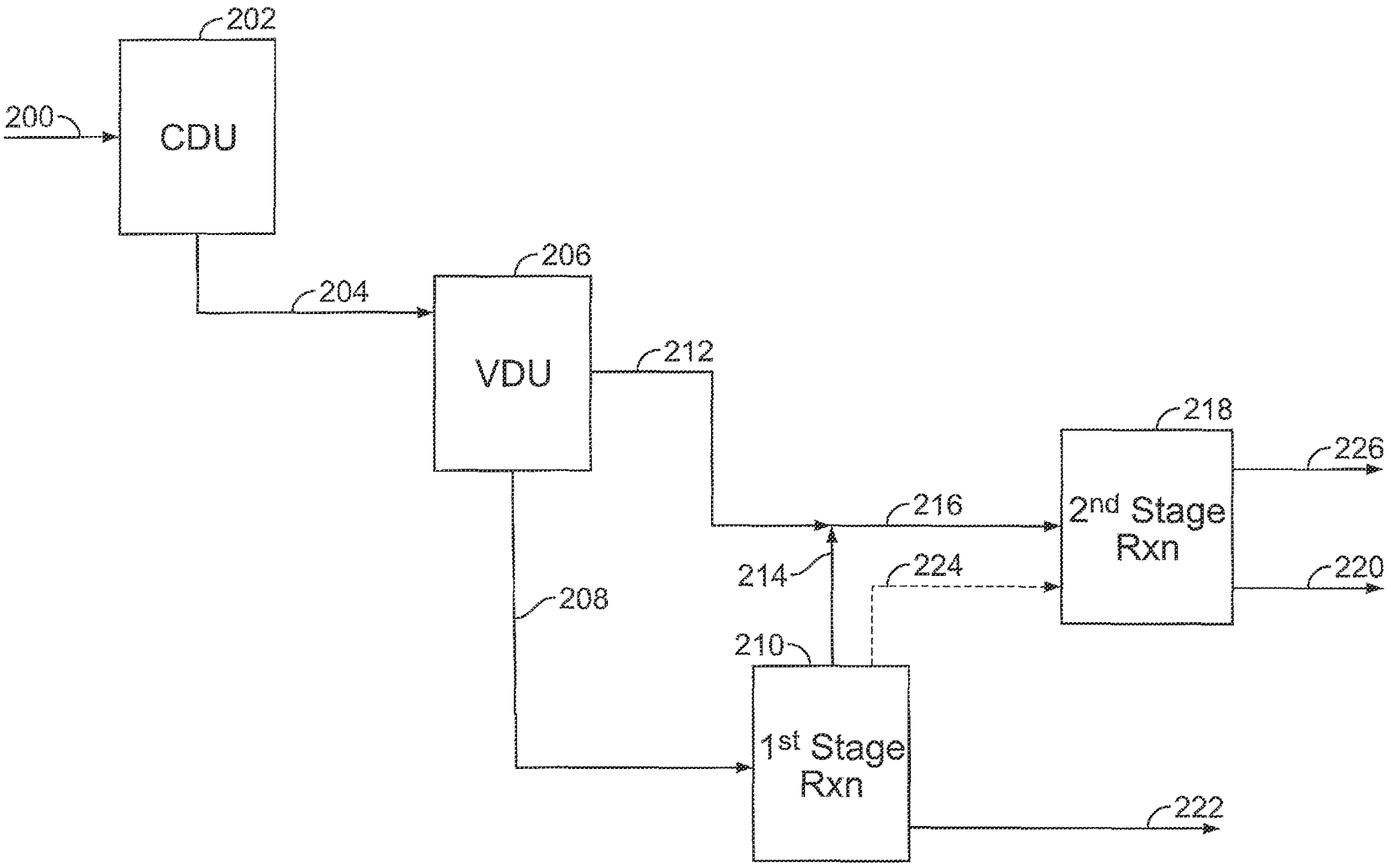
FIG. 4 is a simplified process flow scheme for simulation of a refinery including a slurry phase hydrocracking process unit according to yet another embodiment.

This example according to the invention models one embodiment of a simplified refinery process flow scheme as illustrated in FIG. 4. The refinery process scheme is simplified for computational simulation and includes a stream of crude oil 200 feeding a CDU 202. The atmospheric residue or bottoms 204 of the CDU feeds into the VDU 206. The vacuum residue 208 feeds into the slurry phase first stage hydroconversion section 210 of the VCC. The VGO 212 and the first stage product 214 are introduced as a combined feed 216 into the second stage hydroprocessing reaction section 218 of the VCC. The liquid products 220 are recovered from the second stage hydroprocessing reaction section 218. The VCC residue 222 from the first stage reaction section 210 is assumed negligible relative to other streams. Gases 224 from the first stage reaction section 210 are recovered with the gases 226 from the second stage hydroprocessing reaction section 218 and are assumed negligible relative to other streams. Table 1 lists the mass balance, yield and carbon retention for Example 1.

TABLE 1

| Stream Number | Stream Description | Flow rate (bpd) | Flow rate (metric t/d) | Density (t/m3) | Carbon (metric t/d) | Carbon (wt %) |
|---|---|---|---|---|---|---|
| 200 | Crude Feed | 173,834 | 24,492 | 0.886 | 0 | 0% |
| 204 | Atm. Res. | 87,294 | 13,750 | 0.991 | 11,286 | 82% |
| 208 | Vac Res. | 45,613 | 7,591 | 1.047 | | |
| 212 | VGO to $2^{nd}$ Stage | 41,680 | 6,160 | 0.930 | | |
| 214 | $1^{st}$ Stage Products | 44,133 | 6,300 | 0.898 | | |
| 216 | $2^{nd}$ Stage Feed | 85,813 | 12,460 | 0.913 | | |
| 220 | VCC Products | 92,117 | 12,273 | 0.838 | 10,543 | 86% |

Comparative Example 2

Figure 5:
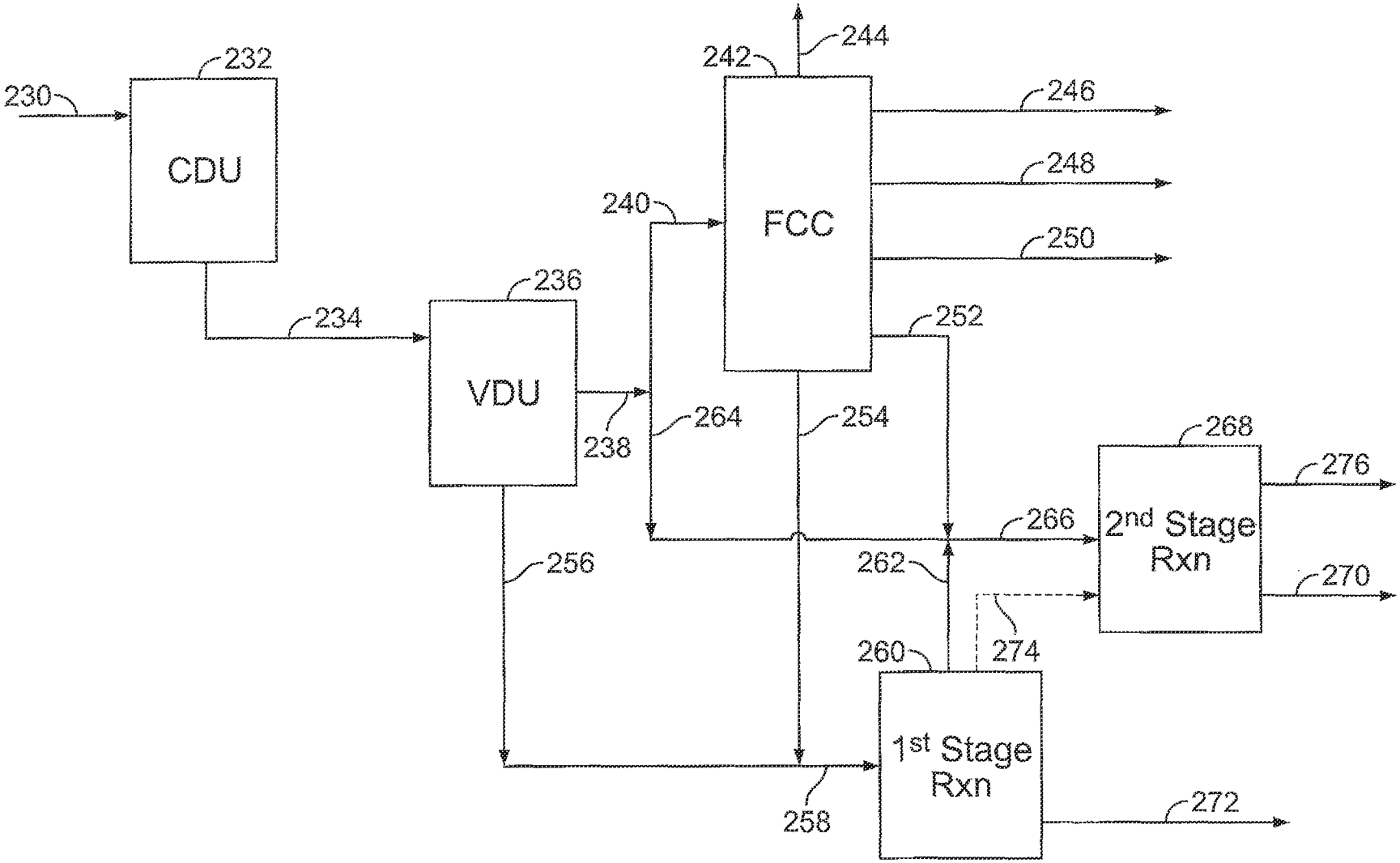
FIG. 5 is a simplified process flow scheme for simulation of a comparative example of a refinery including a slurry phase hydrocracking process unit and a fluid catalytic cracking unit.

This comparative example models a simplified refinery process flow scheme as illustrated in FIG. 5, which includes both a VCC unit and a FCC unit. The refinery process scheme is simplified for computational simulation and includes a stream of crude oil 230 feeding a CDU 232. The atmospheric residue or bottoms 234 of the CDU feeds into the VDU 236. The VGO stream 238 from the VDU 236 may be split such that a first portion 240 of the VGO 238 feeds into the FCC unit 242. This flow scheme accounts for various products of the FCC unit 242 including the coke burn 244, light gases 246, LPG 248, naphtha 250, LCO 252 and slurry oil 254. The slurry oil 254 combines with the vacuum residue 256 to present a combined feed 258 to the first stage hydroconversion reaction section 260 of the VCC unit. The first stage product 262 combines with a second portion 264 of the VGO 238 and the LCO 250 as a combined feed 266 into the second stage hydroprocessing reaction section 268 of the VCC unit. The liquid products 270 are recovered from the second stage hydroprocessing reaction section 268. The VCC residue 272 from the first stage hydroconversion reaction section 260 is assumed negligible relative to other streams. Gases 274 from the first stage hydroconversion reaction section 260 are recovered with the gases 276 from the second stage hydroprocessing reaction section 268 and are assumed negligible relative to other streams. Table 2 lists the mass balance, yield and carbon retention for Comparative Example 2.

TABLE 2

| Stream Number | Stream Description | Flow rate (bpd) | Flow rate (metric t/d) | Density (t/m3) | Carbon (metric t/d) | Carbon (wt %) |
|---|---|---|---|---|---|---|
| 230 | Crude Feed | 173,834 | 24,492 | 0.880 | 0 | 0% |
| 234 | Atm. Res | 87,294 | 13,750 | 0.991 | 11,286 | 82% |
| 238 | VGO | 41,680 | 6,160 | 0.930 | | |
| 262 | VGO to $2^{nd}$ Stage | 0 | 0 | 0.930 | | |
| 240 | FCC Feed | 41,680 | 6,160 | 0.930 | | |
| 244 | Coke Burn | | 342 | | 308 | 90% |
| 246 | FCC Gases | | 200 | | 114 | 57% |
| 248 | FCC LPG | | 952 | | 790 | 83% |
| 250 | FCC Naphtha | 20,853 | 2,509 | 0.757 | 2,120 | 84% |
| 252 | FCC LCO | 1 | 1401 | 1.015 | | |
| 254 | FCC Slurry Oil | 4,387 | 755 | 1.082 | | |
| 256 | Vac Res. | 45,613 | 7,591 | 1.047 | | |
| 258 | VCC Feed | 50,000 | 8,345 | 1.050 | | |
| 262 | $1^{st}$ Stage Products | 48,377 | 6,927 | 0.901 | | |
| 266 | $2^{nd}$ Stage Feed | 57,051 | 8,328 | 0.918 | | |
| 270 | VCC Products | 61,387 | 8,203 | 0.840 | 7,046 | 86% |

Comparative Example 3

Figure 6:
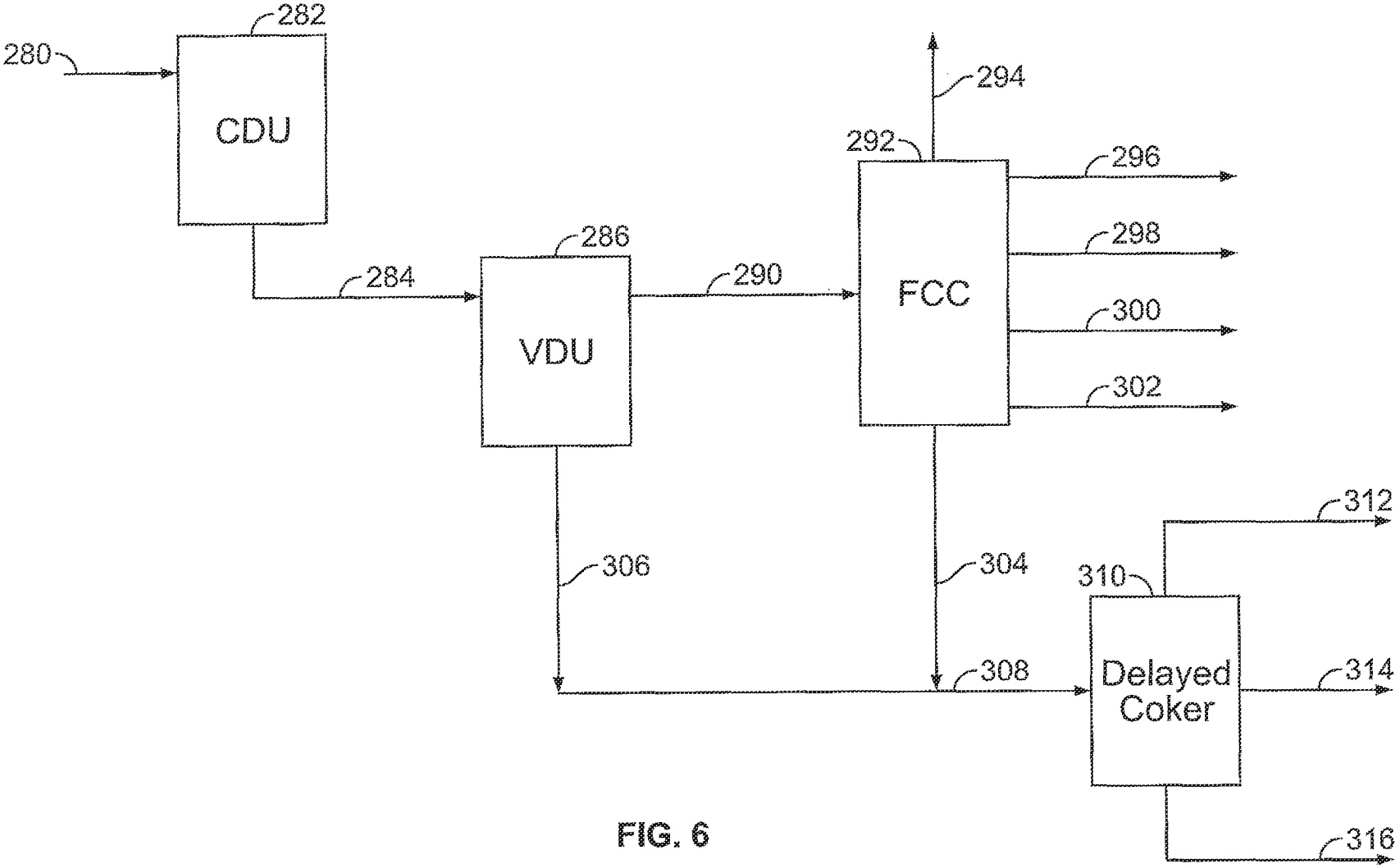
FIG. 6 is a simplified process flow scheme for simulation of a comparative example of a refinery including a delayed coking unit and a fluid catalytic cracking unit.

This comparative example models a simplified refinery process flow scheme as illustrated in FIG. 6, which includes both a delayed coking unit (DCU) and a FCC unit. The refinery process scheme is simplified for computational simulation and includes a stream of crude oil 280 feeding a CDU 282. The atmospheric residue or bottoms 284 of the CDU feeds into the VDU 286. The VGO 290 feeds into the FCC unit 292. This flow scheme accounts for various products of the FCC including the coke burn 294, light gases 296, LPG 298, naphtha 300, LCO 302 and slurry oil 304. The slurry oil 304 combines with the vacuum residue 306 to present a combined feed 308 into the DCU 310. The DCU reaction products include gases 312, liquid products 314 and coke 314. Table 3 lists the mass balance, yield and carbon retention for Comparative Example 3.

TABLE 3

| Stream Number | Stream Description | Flow rate (bpd) | Flow rate (metric t/d) | Density (t/m3) | Carbon (metric t/d) | Carbon (wt %) |
|---|---|---|---|---|---|---|
| 280 | Crude Feed | 173,834 | 24,942 | 0.886 | | |
| 284 | Atm. Res | 87,294 | 13,750 | 0.991 | 11,286 | 82% |

TABLE 3-continued

| Stream Number | Stream Description | Flow rate (bpd) | Flow rate (metric t/d) | Density (t/m3) | Carbon (metric t/d) | Carbon (wt %) |
|---|---|---|---|---|---|---|
| 290 | VGO | 41,680 | 6,160 | 0.930 | | |
| 294 | Coke Burn | | 342 | | 308 | 90% |
| 296 | FCC Gases | | 200 | | 114 | 57% |
| 298 | FCC LPG | | 952 | | 792 | 83% |
| 300 | FCC Naphtha | 20,853 | 2,509 | 0.757 | 2,120 | 84% |
| 302 | FCC LCO | 8,345 | 1,401 | 1.05 | 1,184 | 84% |
| 304 | FCC Slurry Oil | 4,387 | 755 | 1.082 | | |
| 306 | Vac Res. | 45,613 | 7,591 | 1.047 | | |
| 308 | DCU Feed | 50,000 | 8,345 | 1.050 | | |
| 312 | DCU Gases | | 1,482 | | 734 | 50% |
| 314 | DCU Liq Products | 27,825 | 3,981 | 0.900 | 3,420 | 86% |
| 316 | Coke | | 2,882 | | 2,613 | 91% |

Based on the computational simulations of the example and comparative examples shown above, the yield of total liquid products as a percentage relative the atmospheric residue (i.e., CDU bottoms) fed to the VDU is shown for each example in Table 4 below. The carbon retention in the liquid products as a percentage of the carbon on the feed to the VDU is shown for each example in Table 4 below. This data illustrates the known improvements obtained relative to replacing the DCU unit with a VCC unit in a conventional refinery flow scheme including a FCC unit. Moreover, the data shows the superior results obtained for a refinery flow scheme that includes a VCC only without a FCC unit. Accordingly, a refinery process flow scheme in accordance with the teachings herein may achieve a liquid products yield of more than 80%, more than 81%, more than 84%, or preferably more than 85%, and a carbon retention in the liquid products of more than 85%, more than 87%, or preferably more than 90%, relative to the atmospheric residue produced. These results are superior to the results obtained when the refinery flow scheme includes a FCC unit.

TABLE 4

| | Example 1 (FIG. 4) | Comp. Example 2 (FIG. 5) | Comp. Example 3 (FIG. 6) |
|---|---|---|---|
| Configuration | VCC Only | FCC + VCC | FCC + DCU |
| Total liquid products (wt %) | 89.3% | 77.9% | 57.4% |
| Carbon retention (wt %) | 93.4% | 81.2% | 59.6% |

One of ordinary skill in the art may appreciate other advantages and modifications of the above described embodiments based on the teachings herein. However, the above embodiments are for illustrative purposes only. The invention is defined not by the above description but by the claims appended hereto.

The invention claimed is:

1. An integrated hydrocarbon refinery apparatus for producing a light distillate product, the apparatus comprising:

an atmospheric distillation unit;

a vacuum distillation unit receiving a first feedstream from the atmospheric distillation unit;

a slurry phase hydrocracking unit receiving a second feedstream from the vacuum distillation unit and a third feedstream from the atmospheric distillation unit; and a fractionation unit receiving a fourth feedstream comprising a product from the slurry phase hydrocracking unit, and producing products including a naphtha product, a diesel product;

with the proviso that the refinery apparatus does not include a fluid catalytic cracking unit;

wherein the slurry phase hydrocracking unit comprises a first stage hydroconversion slurry reaction section in communication with a second stage hydroprocessing reaction section including a second stage hydrocracking reactor section and a second stage hydrotreating reactor section, wherein the first stage hydroconversion slurry reaction section receives the second feedstream and the second stage hydroprocessing reaction section receives the third feedstream.

2. The integrated hydrocarbon refinery apparatus of claim 1, wherein the fractionation unit includes a product stream in recycle communication with the second stage hydrocracking reactor section.

3. The integrated hydrocarbon refinery apparatus of claim 1, wherein the second stage hydroprocessing reaction section receives a feedstream from the vacuum distillation unit.

4. The integrated hydrocarbon refinery apparatus of claim 1, wherein the slurry phase hydrocracking unit further comprises the second stage hydrotreating reactor section in communication with the fractionation unit, the second stage hydrotreating reactor section receiving a feedstream from the atmospheric distillation unit and the effluent from the second stage hydrocracking reactor section.

* * * * *